United States Patent [19]

Fichter

[11] 4,160,410

[45] Jul. 10, 1979

[54] MARKING DEVICE UTILIZING DUAL ROD POWER CYLINDER

[75] Inventor: Robert Fichter, Woodridge, Ill.

[73] Assignee: Norwood Marking & Equipment Co., Downers Grove, Ill.

[21] Appl. No.: 845,044

[22] Filed: Oct. 25, 1977

[51] Int. Cl.[2] ..... B41F 17/00; B41F 1/44

[52] U.S. Cl. ..... 101/41; 101/10; 101/27; 101/336; 92/166; 400/176; 400/223; 91/462

[58] Field of Search ..... 101/27, 41, 21, 9, 10, 101/336; 400/120, 176, 179–183, 223; 91/462, 236, 411 A; 92/166; 310/23, 34

[56] References Cited

U.S. PATENT DOCUMENTS

| | | | |
|---|---|---|---|
| 2,471,619 | 5/1949 | Hardy | 92/166 |
| 2,547,602 | 4/1951 | Schmitt | 101/27 |
| 2,692,364 | 10/1954 | Palmentola et al. | 310/23 |
| 2,757,938 | 8/1956 | Crowder | 92/166 |
| 3,163,093 | 12/1964 | Gut | 92/166 |
| 3,304,856 | 2/1967 | Birch | 101/27 |
| 3,418,924 | 12/1968 | Kingsley | 101/27 |
| 3,425,009 | 1/1969 | Voigt et al. | 310/34 |
| 3,823,664 | 7/1974 | Shenoha | 101/41 |
| 3,878,776 | 4/1975 | Schneider | 101/41 |
| 3,881,410 | 5/1975 | Shenoha | 101/41 |

*Primary Examiner*—William Pieprz

*Attorney, Agent, or Firm*—Hill, Van Santen, Steadman, Chiara & Simpson

[57] ABSTRACT

An imprint marking device utilizing transfer tape moved from a tape supply reel to a take-up reel across an imprint station with a moving marker head having raised indicia movable against the tape to press the tape against an article to be marked. A tape drive system includes a drive roller and an opposed idler roller. Both the tape drive system and the marker head are actuated by a single power cylinder which has power rods extending from opposite ends connected to a single common internal piston, one of the rods operating the marker head and the other of the rods operating the tape drive system.

13 Claims, 7 Drawing Figures

Fig. 1
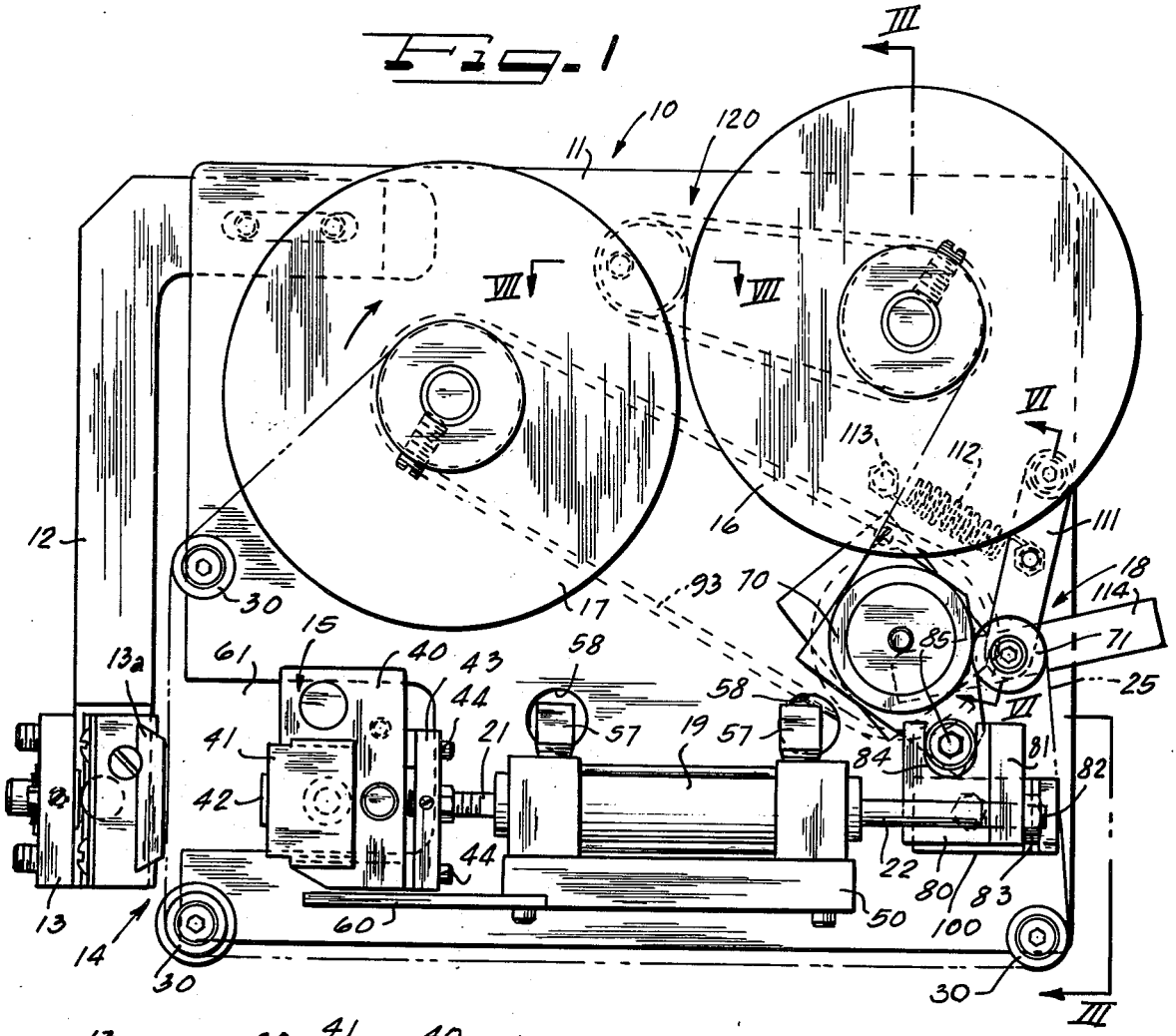
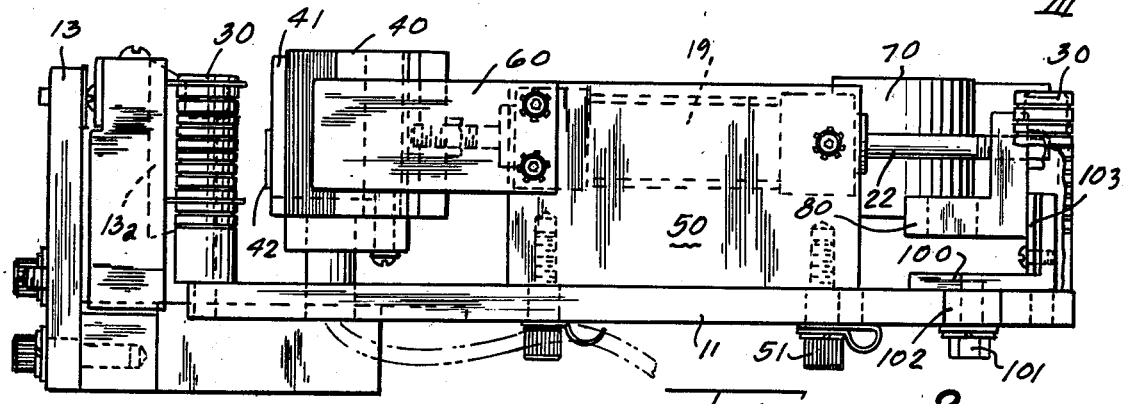
Fig. 2
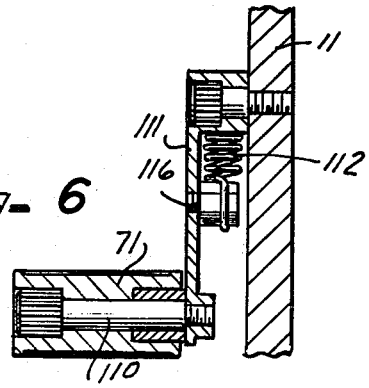
Fig. 6
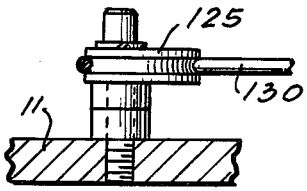
Fig. 7

Fig. 3
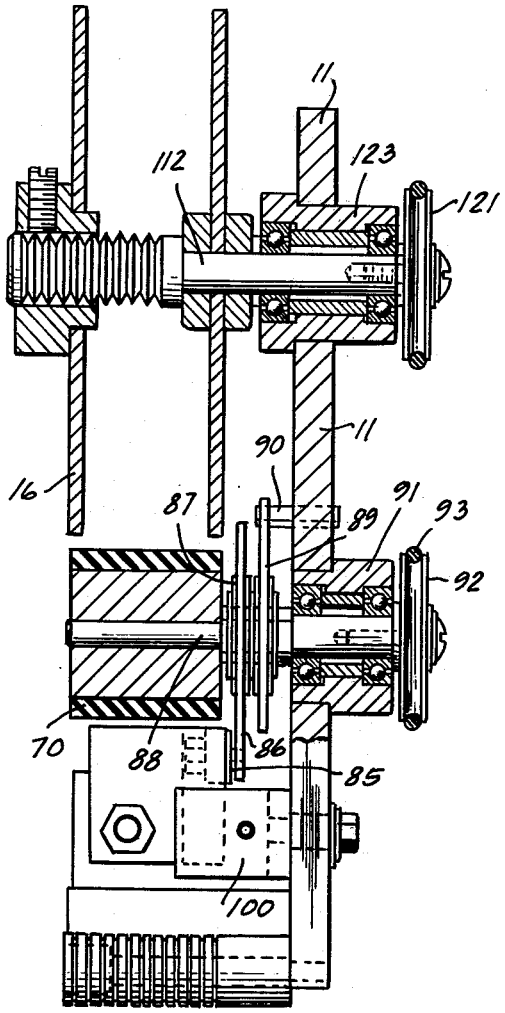
Fig. 4
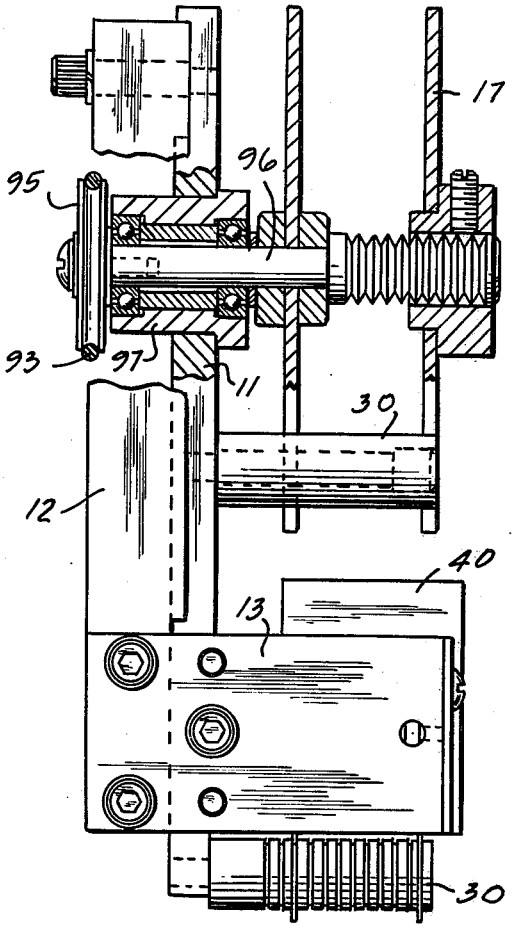
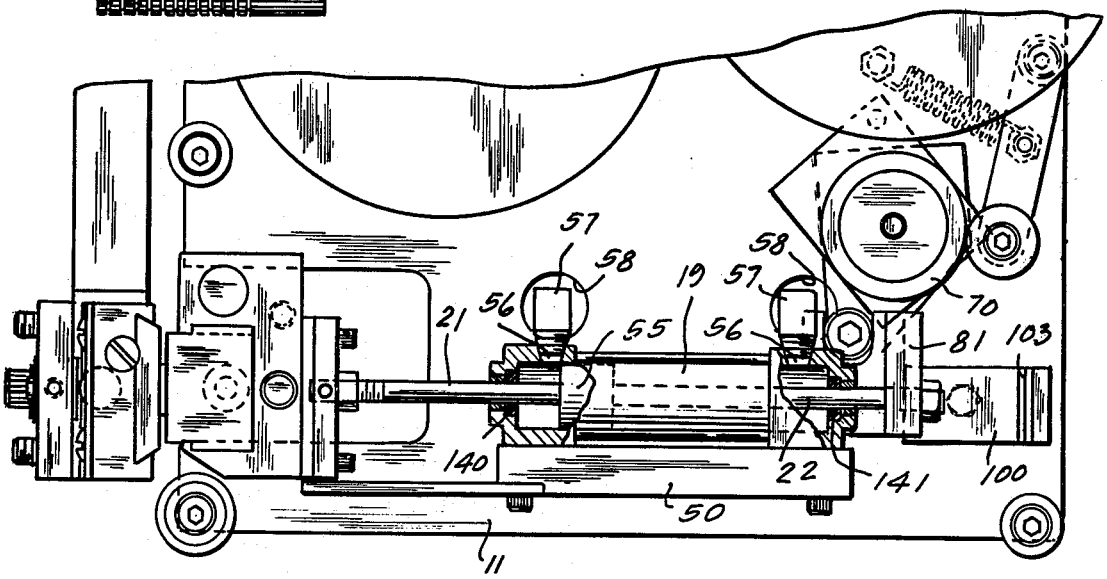
Fig. 5

MARKING DEVICE UTILIZING DUAL ROD POWER CYLINDER

BACKGROUND OF THE INVENTION

1. Field of the Invention

This invention relates to marking systems and more particularly to transfer tape imprint markers.

2. Prior Art

Imprint markers are commonly used in industry today. A frequent usage is for applying last minute information to product packaging, such as code dating, net weight, price and the like which information cannot conveniently be applied to the packaging at the time of original printing of the packaging.

Such marking devices generally fall into one of three catagories: ink devices such as those using stamp pads or ink rollers; inked tape devices; and transfer tape devices. Transfer tape and ink tape devices can, for the purposes of this invention be considered substantially the same since both rely upon movement of a tape, either called a ribbon or a foil, past an imprint marker station where a marker head having raised indicia thereon is contacted with the tape urging the tape, in the areas of the raised indicia, into contact with the product to be marked.

A common feature to such systems is the necessity of advancing the tape between imprints. This is particularly critical in connection with transfer tape where substantially all of the pigment has been transferred from a carrier strata to the product to be marked in the contact areas of the raised indicia. Should the raised indicia hit the same area a second time no pigment will be transferred.

It has been a common constructional method in the past to use power actuators such as pneumatic cylinders to move both the marking head and the tape drive system. In the context of this invention, a pneumatic cylinder can be either air, air-hydraulic, hydraulic, or in certain limited instances, electrical, including solenoids and trapped wax power members.

Commonly such marking devices have connected the power arm of the pneumatic cylinder to a cam and follower assembly which is operatively connected to the marker head or to a moving anvil in the case of a stationary marker head. A linkage system then connects the cam or follower to the tape drive.

Examples of such prior constructions are to be found in U.S. Pat. No. 3,878,776 utilizing a moving anvil and linkage to a tape drive and U.S. Pat. No. 3,823,664 utilizing a common slide bar having contoured slots in which follower wheels ride, one of which is connected to the moving anvil and the other of which is connected to a tape drive system. A construction similar to U.S. Pat. No. 3,823,664 but where a stationary anvil is utilized in association with a moving marker head with the marker head attached to the slide member through a contoured groove connection is also found in the art.

Finally it has been known to use separate pneumatic actuators for the marking head and for the tape drive. See U.S. Pat. No. 3,881,410.

The use of separate power supplies for the marking and tape portions of the marking device is uneconomical and gives rise to control and timing problems.

The use of linkage systems from a common power arm of a single pneumatic actuator both creates sloppiness within the system and interposes unnecessary parts between the pneumatic actuator and the device that it is actuating, causing problems of space utilization and pivot area wear.

It would, therefore, be an advance in the art to provide an imprint marker which eliminates the prior multi-piece linkage and slide systems while at the same time utilizing only a single pneumatic actuator.

DESCRIPTION OF THE PREFERRED EMBODIMENT

It is therefore a principle object of this invention to provide a transfer tape imprinter which utilizes a single pneumatic cylinder both for movement of the marking head and for movement of the tape drive but which avoids the complex linkage systems of prior constructions by eliminating use of a single power arm for both marker head and tape drive activations.

Such a construction is achieved by utilizing a pneumatic cylinder having power rods projecting from both axial ends of the cylinder. One of the power rods is connected directly to the marker head assembly while the other power rod drives the tape feed through a simple linkage. By utilizing a dual rod cylinder, it is unnecessary to complicate the pneumatic cylinder to a print head connection by any linkage or other interposed construction to provide for drive to the tape transport. Further, by providing an independent tape transport from a second power rod, the tape transport mechanism can be located entirely away from the marker head thereby avoiding space problems while at the same time allowing the tape drive to be constructed substantially without reference to the marking head drive so that only factors pertinent to the tape drive need be considered. This allows simplification of the tape drive power train. Additionally, use of a single cylinder avoids timing problems.

In the preferred embodiment illustrated, a common plate frame is provided which has rotatable tape supply and take-up reels mounted thereon and which support a dual rod cylinder with the rods projecting axially of the cylinder. One of the rods is connected directly to a marker head carrier member thereby providing a direct drive to the marker head. The other rod is attached directly to a cam block having a cam wheel riding in a slot. The use of the cam block allows the linear back and forth motion of the power arm to be transferred to an arcuate motion of the cam wheel. The cam wheel is attached to an arm of a one-way clutch driving shaft attached to the tape drive roller. A second one-way clutch is attached to the roller shaft and to the frame to prevent back rotation upon reverse movement of the pneumatic cylinder power arm.

An idler roller is urged against the drive roller with the tape passing therebetween, the tape thereafter being guided through an imprint station underlying the marker head to the take-up reel. The take-up reel is driven by a power take-off from the drive roll.

In the preferred embodiment, the drive roll is positioned up-stream of the imprint station and pushes the tape from the supply reel towards the take-up reel. The clutches are arranged to advance the tape when the print head is being drawn back from the imprint station. The drive to the take-up reel is a slip drive constructed such that although the take-up reel maintains a pressure drawing the tape onto the reel, the movement of the tape is controlled by the tape push drive roll assembly.

It is therefore an object of this invention to provide a transfer tape marking device utilizing a pneumatic cylinder having power arms extending from either axial end thereof, one of the power arms connected to a marker head and the other of the power arms connected to a tape drive.

It is another and more specific object of this invention to provide a transfer tape marker device having a moving marker head and a tape drive for advancing a tape between supply and take-up reels past an imprint station, the marker head moving towards and away from the imprint station, a single pneumatic cylinder having power arms projecting from either axial end, one of which is attached to the marker head for movement thereof and the other one of which is operatively attached to a drive wheel for a tape drive mechanism, the tape drive being through a one-way clutch whereby tape is advanced during only one of the forward or backward movements of the marker head.

It is another, particular, object of this invention to provide an imprint marker device having a single pneumatic cylinder with power rods projecting from either end thereof, one of which is attached to a moving marking head and the other of which is attached to a tape drive system, the tape drive system including a drive roller and opposed spring biased idler roller with the tape passing therebetween, the tape drive being on the in-feed side of an imprint station and adapted to push the tape through the station, the tape drive being actuated only as the marker head is being withdrawn from the imprint station.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

BRIEF DESCRIPTION OF THE DRAWINGS

FIG. 1 is a side elevational view of a marker according to this invention.

FIG. 2 is a bottom view of the marker of FIG. 1.

FIG. 3, on page 2 of the drawings, is a cross-sectional view of the marker taken along the lines III—III of FIG. 1.

FIG. 4 is an end plan view, partially in section, of the marker of FIG. 1 taken from the left hand side of FIG. 1.

FIG. 5 is a fragmentary view similar to FIG. 1 illustrating imprinting at the marking station.

FIG. 6 on page 1 of the drawings, is an enlarged fragmentary view partially in section of the idler roller connection taken along the lines VI—VI of FIG. 1.

FIG. 7 on page 1 of the drawings, is an enlarged fragmentary cross-sectional view taken along the lines VII—VII of FIG. 1.

DESCRIPTION OF THE PREFERRED EMBODIMENTS

FIG. 1 illustrates, generally, a marker assembly according to this invention for use with transfer tape. The assembly includes a common plate frame 11 having an anvil or support arm 12 attached thereto. At a free end of the anvil support arm, an adjustable anvil assembly 13 is attached having a pad 13A underlying an imprint station 14. A marker head assembly 15 acts at the imprint station to imprint a product to be marked. The frame 11 rotatably supports tape supply 16 and take-up 17 reels which supply and take up transfer tape 25. A tape drive assembly 18 is also carried by the frame as is a pneumatic cylinder 19 having power rods 21 and 22 projecting from opposite axial ends thereof. Guides 30 guide the tape from the supply reel 16 to the take-up reel 17 past the imprint station 14. As shown, one of the power arms 21 is attached to the marker head assembly 15 while the other power arm 22 is operatively attached to the tape drive 18.

The marker head assembly, in the embodiment illustrated, which makes use of transfer tape having a transferable pigment layer coated on a base strata, includes a heater block 40 which is electronically heated and carries a type bar 41 having raised indicia 42 thereon. A carrier member 43 is bolted to the end of the power arm 21. Adjustment screws 44 connect the carrier to the heater block. As the power arm 21 is moved inwardly and outwardly of the cylinder 19, the marker head will be moved towards and away from the imprint station 14.

The pneumatic cylinder 19 is attached to a ledge 50 which in turn is attached to the frame 11 by means of bolts 51. The cylinder 19 is of a common design and has an internal piston 55 received in a cylinder. The piston being attached to the power rods 21 and 22 and dividing the cylinder into two chambers each of which has a combination inlet and exhaust port 56 which is in communication to a nipple fitting 57 accessible from the back of the frame 11 through openings 58 for attachment to a pneumatic or hydraulic source including appropriate valving for controlling the activation of the cylinder.

Although the controlling forms no part of this invention, it is to be understood that such controlling can be timed, can be activated by product sensing, can provide for a dwell period of the indicia at the imprint station, can control speed of operation so as to provide smooth tape movement and can be otherwise varied to suit the individual printing needs in connection with which the marking assembly is being used.

The ledge 50 has a projection 60 underlying the marker head preventing rotation thereof. Additionally the frame 11 is provided with a large slot opening 61 through which the power and thermostat controls for the heater block can be fed from the reverse side of the frame 11.

The tape drive 18 includes a drive roller 70 and an opposed idler roller 71 with the tape being wound through the nip area between the rolls whereby rotation of the drive rolls 70 will push the tape from the tape supply reel towards the take-up reels 17.

As best illustrated in FIGS. 1 and 5, the tape drive includes a cam block 80 affixed to the end of power arm 22. The cam block has a back wall 81 through which the power arm extends, the power arm being provided with a threaded end 82 for receipt of a nut 83 whereby the position of the cam block 80 on the power arm can be adjusted. The cam block includes a slot 84 which receives a cam roller 85 which, as best illustrated in FIG. 3 is attached to a lever plate 86 of a one-way clutch 87. The one-way clutch is affixed to the shaft 88 of the drive roller 70. A second one-way clutch 89 affixed to the shaft 88 is pinned to the frame 11 as at 90. The two one-way clutches cooperate such that movement of the power arm 22 away from the cylinder will cause rotation of the drive roller 70 while movement of the power arm 22 towards the cylinder 19 will not cause rotation of the drive cylinder. The shaft 88 is affixed to the frame 11 and projects therethrough through a bearing block 91 and terminates in a sheave wheel 92 which rotates with the shaft. The sheave wheel by means of a belt or similar drive member 93 drives a sheave wheel 95 attached to a shaft 96 of the take-up reel 17, the shaft 96 being supported in a bearing block 97 attached to the frame 11. A bumper member 100 is adjustably attached to the frame by means of bolt 101 received through an elongated frame slot 102. The bumper member has a rubber padded bumper wall 103 which acts as a stop for the cam block back wall 81.

As best illustrated in FIG. 6, the idler roll 71 is rotatably carried on a shaft 110 affixed to the end of arm 111 which in turn is pivotably attached to frame 11. A coil spring 112 has one end attached to the frame 11 as at 113 and the other end attached to an intermediate portion of the lever arm as at 116. The spring 112 biases the idler roll 71 against the drive roll 70 closing the nip and entrapping the tape. The spring 112, if desired, may have an overcenter attachment position 113 so that the idler roll can be drawn outwardly and snap into a held open position to facilitate tape changing. A release arm 114 may also be provided.

A brake system 120 is provided for the supply reel 16 and includes a sheave wheel 121 attached to an end of supply reel shaft 122, the supply reel shaft being attached to the frame 11 through a bearing assembly 123 as best illustrated in FIG. 3. A stationary sheave reel 125 is eccentrically affixed to the frame 11 as illustrated in FIG. 7. A belt or long Oring 130 passes between the sheave wheels 125 and 121 providing a brake for the supply reel.

One feature of the present invention is the fact that the tape drive 18 operates only on the backstroke of the marker head assembly 15 so that tape is moved past the imprint station 14 only as the marker head is being withdrawn. This means that there will be no tape motion during imprint as the marker head is being moved into the imprint station to move the tape against the product and the product against the anvil 13. Such movement could stress the tape, or result in a smeared print. Further, the tape drive pushes the tape through the imprint station rather than pulling it through the imprint station so that should the tape tend to stick to the raised indicia 42, it will not be ripped or stressed by stretching it over the indicia since the tape will be pushed by the tape drive to free the tape at the raised indicia as the marker head is being withdrawn. Thereafter the slight stress being applied to the tape by the take-up reel through the belt 93 will draw the tape on the take-up reel.

One advantageous feature of the present construction is the fact that both the marker head and the tape drive connections are axially aligned with the cylinders such that there are no side stresses applied to the power arms. The power arms, being received in bushings 140 and 141 at the ends of the air cylinder and being connected together at the piston, provide a rigid, smooth working power train which is not subjected to side stresses. Other advantages of a double rod air cylinder are the provisions of an increased bearing surface caused by the use of bearings at both ends of the cylinder. This not only provides for a longer service life but also provides a much steadier power rod when either of the rods 21 or 22 is fully extended. This is particularly advantageous in connection with the print rod 21.

It can therefore be seen from the above that my invention provides an improved marker device, particularly of the transfer tape variety, wherein a marker head is moved towards and away from an imprint station while transfer tape is moved by means of a tape drive, the movement of the marker head being caused by a first power arm of a hydraulic cylinder and the movement of the tape drive being caused by a second power arm of the hydraulic cylinder, the power arms projecting from opposite ends of the cylinder and the marker head and tape drives being located on opposite ends of the cylinder.

Although the teachings of my invention have herein been discussed with reference to specific theories and embodiments, it is to be understood that these are by way of illustration only and that others may wish to utilize my invention in different designs or applications.

I claim as my invention:

1. An imprint marker device utilizing transfer tape comprising: a movable marker head having raised indicia thereon, the head movable towards and away from an imprint station, a frame member, tape supply and take-up reels rotatably carried by said frame member, guide means guiding transfer tape from the supply reel to the take-up reel across the imprint station, said guide means carried by said frame, a rotatable tape drive roll and opposed spring biased idler roll carried by said frame with said tape passing between said rolls, a pneumatic power cylinder carried by said frame having first and second moving power rods projecting from opposite ends thereof, said first rod connected to said marker head to move the same, said second rod operatively connected to said drive roller to rotate the same to advance said tape, means connecting said drive roll to said take-up reel whereby rotation of the drive reel rotates said take-up reel and said power arms commonly operated by said pneumatic power cylinder whereby when one power arm is projected from said cylinder the other power arm is drawn into said cylinder.

2. The device of claim 1 wherein the marker head and tape drives are located at opposite ends of the cylinder.

3. The device of claim 2 wherein the tape drive includes a one-way clutch connection to the power arm such that the tape drive advance is only upon one of the projecting or retracting linear movements of the associated second power arm.

4. The device of claim 3 wherein the tape drive is positioned on the in-feed side of the imprint station and pushes tape from the tape supply reel through the imprint station.

5. The device of claim 4 wherein the tape drive is activated to move tape only when the marker head is being retracted from the imprint station.

6. The device of claim 5 wherein the means contacting the drive roll to the take-up reel includes a slip drive connection.

7. The device of claim 6 wherein the supply reel is provided with a rotation brake resisting rotation of the supply reel.

8. The device of claim 7 wherein the cylinder is axially aligned with the marker head.

9. The device of claim 8 wherein the marker head to first power rod connection is a direct rigid connection.

10. The device of claim 9 wherein the tape drive includes a cam block affixed to the second power rod, a cam wheel riding in a slot of the block, said cam roller affixed to a one-way clutch, said one-way clutch affixed to a shaft of the drive roll.

11. The device of claim 10 wherein a second one-way clutch is affixed to the shaft of the drive roll and to the frame preventing back rotation of the drive roll.

12. The device of claim 11 wherein the frame is a single plate member.

13. In an imprint marker device utilizing transfer tape and a marker head movable towards and away from an imprint station with a transfer tape drive mechanism moving tape from a tape supply reel past the imprint station to a tape take-up reel, the improvement of a single pneumatic power cylinder having power rods projecting from opposite axial ends thereof, one of said rods attached to said marker head and moving same towards and away from said imprint station the other of said rods operatively attached to said tape drive.

* * * * *